US009320981B2

(12) United States Patent
Dawson

(10) Patent No.: US 9,320,981 B2
(45) Date of Patent: Apr. 26, 2016

(54) FLYING DISCS AND METHODS OF MAKING AND USING THE SAME

(71) Applicant: Charles B. Dawson, McDonough, GA (US)

(72) Inventor: Charles B. Dawson, McDonough, GA (US)

( * ) Notice: Subject to any disclaimer, the term of this patent is extended or adjusted under 35 U.S.C. 154(b) by 0 days.

(21) Appl. No.: 14/741,385

(22) Filed: Jun. 16, 2015

(65) Prior Publication Data

US 2015/0360138 A1 Dec. 17, 2015

Related U.S. Application Data

(60) Provisional application No. 62/012,852, filed on Jun. 16, 2014.

(51) Int. Cl.
*A63H 33/18* (2006.01)
*H05B 33/00* (2006.01)

(52) U.S. Cl.
CPC ..... *A63H 33/18* (2013.01)

(58) Field of Classification Search
CPC ..... A63H 17/00; A63H 17/26; A63H 17/28; A63H 33/00; A63H 33/18; A63H 33/22; H05B 33/0842; H05B 37/00
USPC ..... 446/46–47, 175, 219, 484
See application file for complete search history.

(56) References Cited

U.S. PATENT DOCUMENTS

| | | | | | |
|---|---|---|---|---|---|
| 4,869,699 | A * | 9/1989 | Plambeck | A63H 33/425 | 446/46 |
| 4,929,212 | A * | 5/1990 | Li | A63H 33/18 | 446/46 |
| 5,319,531 | A * | 6/1994 | Kutnyak | A63H 33/18 | 362/184 |
| 5,611,720 | A * | 3/1997 | Vandermaas | A63B 65/10 | 446/47 |
| 6,184,726 | B1 * | 2/2001 | Haeberli | G11C 5/145 | 327/307 |
| 2012/0258802 | A1 * | 10/2012 | Weston | A63F 13/10 | 463/37 |

* cited by examiner

*Primary Examiner* — Kien Nguyen
(74) *Attorney, Agent, or Firm* — Withers & Keys, LLC

(57) ABSTRACT

Flying discs (i.e., similar to FRISBEE® brand flying discs) suitable for use in a disc golf game or ultimate golf game are disclosed. Methods of making and using flying discs are also disclosed.

19 Claims, 6 Drawing Sheets

FLYING DISCS AND METHODS OF MAKING AND USING THE SAME

CROSS-REFERENCE TO RELATED APPLICATIONS

This patent application claims the benefit of priority to U.S. provisional patent application Ser. No. 62/012,852 entitled "FLYING DISCS AND METHODS OF MAKING AND USING THE SAME" filed on Jun. 16, 2014, the subject matter of which is incorporated herein in its entirety.

FIELD OF THE INVENTION

The present invention relates generally to flying discs (i.e., similar to FRISBEE® brand flying discs) suitable for use in a disc golf game or ultimate golf game. The present invention further relates to methods of making and using flying discs.

BACKGROUND OF THE INVENTION

There is a need in the art for improved flying discs (i.e., similar to FRISBEE® brand flying discs).

SUMMARY OF THE INVENTION

The present invention addresses some of the shortcomings in the art by the discovery of improved flying discs (i.e., similar to FRISBEE® brand flying discs).

Accordingly, in one exemplary embodiment, the present invention is directed to a flying disc, the flying disc comprising: a disc body comprising (i) a central body portion forming an upper surface of said disc body, and (ii) an outer periphery surrounding said central body portion; and a signal-generator positioned along said upper surface, said signal-generator being capable of generating a first signal when said disc body is rotating in a first direction, said first direction being substantially perpendicular to a dissecting disc body axis extending through said disc body and substantially perpendicular to said disc rim, and a second signal when said disc body is rotating in a second direction opposite said first direction, said second signal being different from said first signal.

In another exemplary embodiment, the flying disc of the present invention comprises: a disc body comprising (i) a central body portion forming an upper surface of said disc body, and (ii) a disc rim extending downward from an outer periphery of said central body portion, said disc rim forming a lowermost surface of said disc body; and a signal-generator positioned along said upper surface, said signal-generator being capable of generating a first signal when said disc body is rotating in a first direction, said first direction being substantially perpendicular to a dissecting disc body axis extending through said disc body and substantially perpendicular to said disc rim, and a second signal when said disc body is rotating in a second direction opposite said first direction, said second signal being different from said first signal.

The present invention is even further directed to methods of making flying discs. In one exemplary embodiment, the method of making a flying disc comprises: attaching a signal-generator to a disc body, the signal-generator being capable of generating a first signal when the disc body is rotating in a first direction, the first direction being substantially perpendicular to a dissecting disc body axis extending through the disc body, and a second signal when the disc body is rotating in a second direction opposite the first direction, the second signal being different from the first signal.

The present invention is also directed to methods of using flying discs. In one exemplary embodiment, the method of using a flying disc comprises: throwing the flying disc to cause the flying disc to spin in either a first direction or a second direction, the second direction being opposite the first direction.

These and other features and advantages of the present invention will become apparent after a review of the following detailed description of the disclosed embodiments and the appended claims.

BRIEF DESCRIPTION OF THE FIGURES

The present invention is further described with reference to the appended figure, wherein.

DETAILED DESCRIPTION OF THE INVENTION

Figure 1:
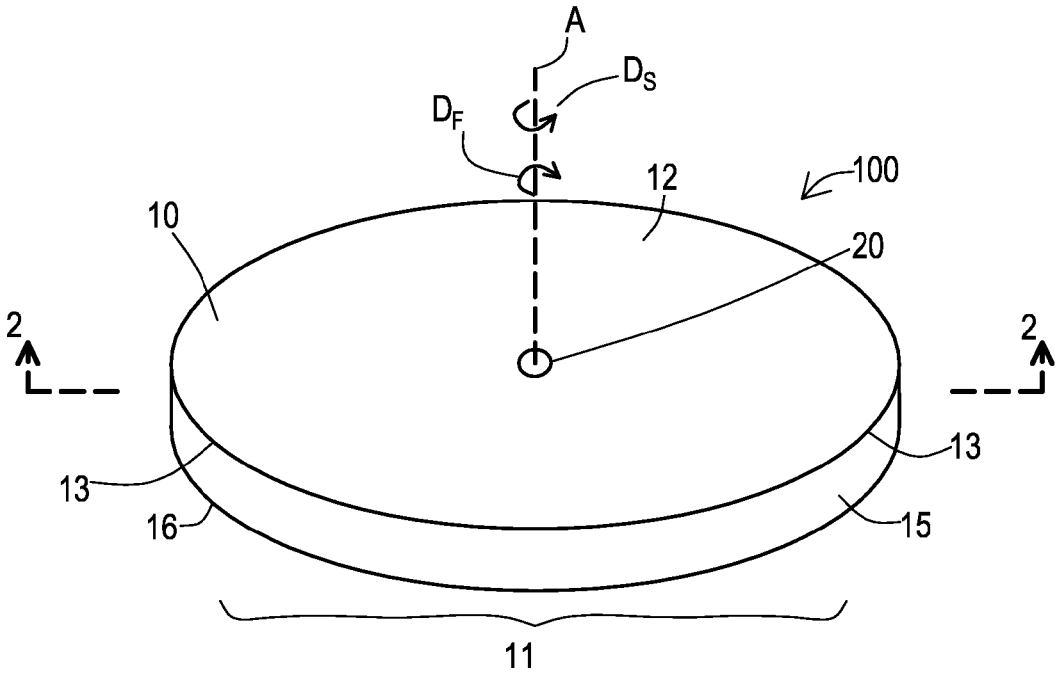
FIG. 1 depicts an exemplary flying disc of the present invention.

The present invention relates to (1) flying discs, and (2) methods of making and using flying discs.

Embodiments of the present invention are further described below and in the accompanying figures.

ADDITIONAL EMBODIMENTS

Flying Discs

1. A flying disc 100 comprising: a disc body 10 comprising (i) a central body portion 11 forming an upper surface 12 of said disc body 10, and (ii) an outer periphery 13 surrounding said central body portion 11; and a signal-generator 20 positioned along said disc body 10, said signal-generator 20 being capable of (1) generating a first signal when said disc body 10 is rotating in a first direction $D_f$, said first direction $D_f$ being substantially perpendicular to a dissecting axis A extending through said central body portion 11 of said disc body 10, and (2) generating a second signal when said disc body 10 is rotating in a second direction $D_s$ opposite said first direction $D_f$, said second signal being identical to or different from said first signal.

2. The flying disc 100 of embodiment 1, wherein said first and second signals each independently comprise a color.

3. The flying disc 100 of embodiment 1 or 2, wherein said first and second signals each independently comprise a color, said color being selected from the group consisting of red, yellow, blue, green, purple, orange, or any other color formed from any combination of two or more of red, yellow, blue, green.

4. The flying disc 100 of any one of embodiments 1 to 3, wherein said first and second signals each independently comprise a color, said color being selected from the group consisting of red, yellow, blue and green.

5. The flying disc 100 of any one of embodiments 1 to 4, wherein said first and second signals each independently comprise a sound.

6. The flying disc 100 of any one of embodiments 1 to 5, wherein said second signal is different from said first signal.

7. The flying disc 100 of any one of embodiments 1 to 6, wherein said signal-generator 20 comprises (i) a first component 21 that detects rotational (i.e., either in direction $D_f$ or $D_s$) of said disc body 10, (ii) a second component 22 capable of detecting rotational direction (i.e., either direction $D_f$ or $D_s$), (iii) a signaling device 23, and (iv) circuitry 24 that connects said first component 21, said second component 22, and said signaling device 23 to one another. It should be understood that circuitry 24 may comprise wired and/or wireless components so as to connect first component 21, second component 22, and signaling device 23 to one another wirelessly or with wires or any combination thereof.

Figure 2:
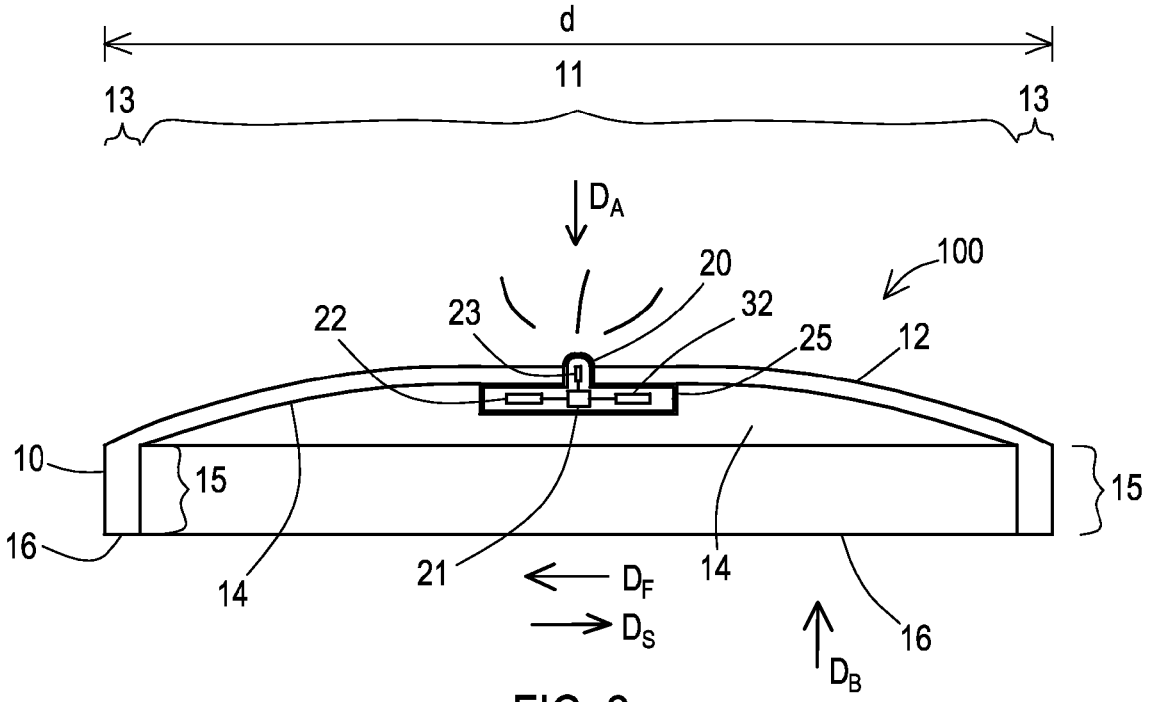
FIG. 2 depicts a cross-sectional view of the exemplary flying disc shown in FIG. 1 as viewed along line 2-2 shown in FIG. 1.
Figure 3:
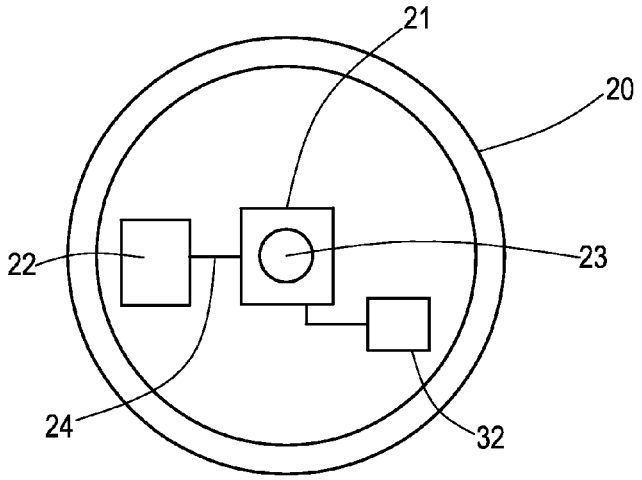
FIG. 3 depicts a top view of the exemplary signal-generator shown in FIGS. 1-2 as viewed along direction $D_A$ as shown in FIG. 2.
Figure 4:
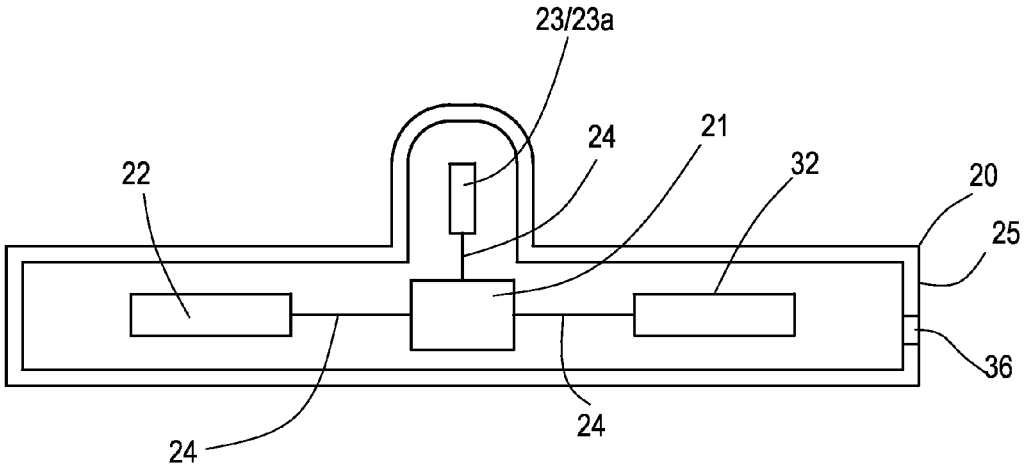
FIG. 4 depicts a close-up side view of the exemplary signal-generator shown in FIG. 2.
Figure 6:
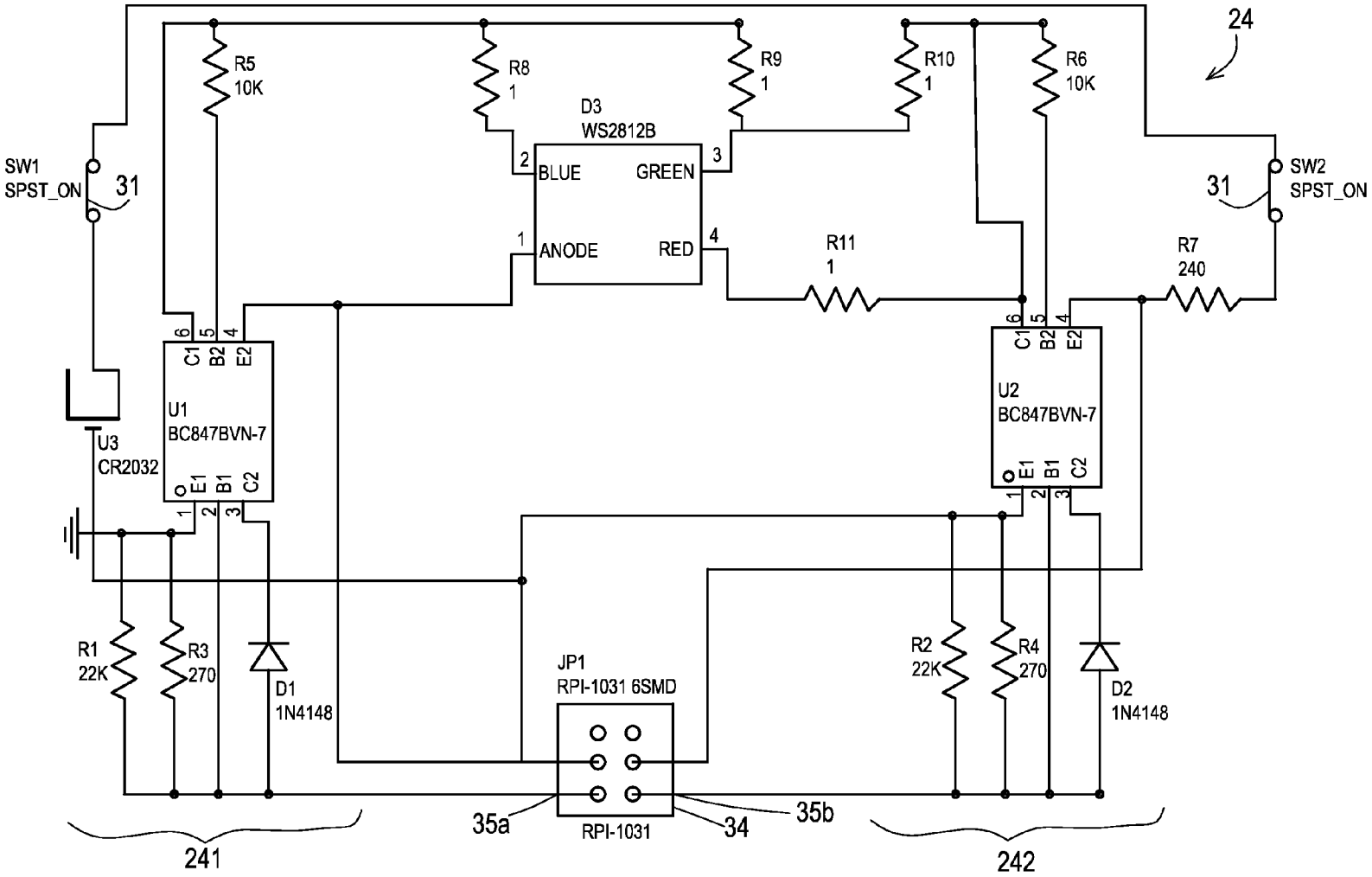
FIG. 6 depicts an exemplary schematic diagram of an exemplary circuitry that may be used in the exemplary signal-generator shown in FIGS. 1-2.

8. The flying disc 100 of embodiment 7, wherein said first component 21 comprises at least two or more rolling ball tilt switches 31 that detect spin of flying disc 100. See, for example, rolling ball tilt switches SW1 and SW2 shown in FIGS. 6-7A. In operation, a pair of Lacoste rolling ball tilt switches 31 may be used to detect directional spin (i.e., rotation). When the circuit 24 (i.e., via the flying disc 100) is tilted, only one of the two switches 31 is closed or activated, so the circuit remains off. When the circuit 24 (i.e., via the flying disc 100) experiences rotation, both switches 31 become activated at once as the internal balls (not shown) are forced outward (i.e., in directions $C_1$ and $C_2$ shown in FIG. 7A) and away from a center of rotation A (as shown in FIG. 1). This connects the remainder of the circuit 24 to power from a battery 32 (as shown in FIGS. 2-4), acting as an "ON" switch. This type of circuit is referred to herein as a "centrifugal circuit," namely, a circuit that is activated by centrifugal force acting on the two strategically placed rolling ball tilt switches SW1 and SW2. The impulse provided when the circuit 24 (i.e., via the flying disc 100) is forced into a spin also causes a ball (not shown) in a 30 degree tilt switch (i.e., second component 22) (see exemplary tilt switch 34, labeled JP1, shown in FIGS. 6-7A) to hit one wall 35*a* or the other 35*b* depending on the direction of spin. This routes power to one of two routes corresponding, for example, to a different color LED 23*a* depending on which side (i.e., wall 35*a* or 35*b*) is hit. In practice, the ball will hit the first wall (i.e., wall 35*a* or 35*b*) and bounce off prematurely disconnecting the circuit 24 and only giving a flash of light from the LED 23*a*. To provide a steady output corresponding to the first wall (i.e., wall 35*a* or 35*b*) that is hit, a transistor-based latch circuit 241 and 242 may be incorporated. (See, for example, FIG. 6, which discloses exemplary latch circuit 241 comprising transistor U1, resistors R1, R3 and R5, and diode D1; and exemplary latch circuit 242 comprising transistor U2, resistors R2, R4 and R6, and diode D2.) In this embodiment, the first wall (i.e., wall 35*a* or 35*b*) that is contacted after the circuit 24 is activated by rotation will, for example, light an LED 23*a* which remains latched in an "ON" position until spinning (i.e., of the flying disc 100) ceases. In this way, the LED 23*a* will light for the duration of the spinning disc (i.e., the flying disc 100) flight, but will go out when spinning stops saving battery life. Commercially available rolling ball switches 31 suitable for use in the present invention include, but are not limited to, Lacoste 30 degree rolling ball tilt switches (e.g., Part No. 107-2010-EV) and Lacoste rolling ball 15 degree tilt switches (e.g., Part No. SW-520D).

9. The flying disc 100 of embodiment 7 or 8, wherein said second component 22 comprises at least one rolling ball tilt switch 34 that detects direction of spin of flying disc 100. See, for example, four directional tilt sensor JP1 (i.e., rolling ball tilt switch 34) shown in FIGS. 6-8.

10. The flying disc 100 of embodiment 7, wherein said first component 21 comprises a gyroscope (not shown).

11. The flying disc 100 of any one of embodiments 7 to 10, wherein said signaling device 20 comprises one or more light-emitting devices 23*a*.

Figure 5A:
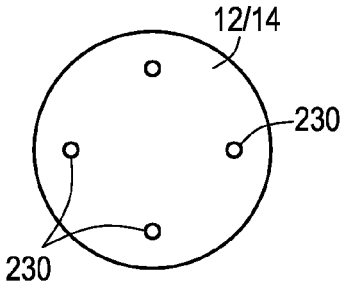
FIGS. 5A-5C depict various light displays that could be used along upper and/or lower surfaces of the exemplary flying disc shown in FIG. 1.
Figure 5B:
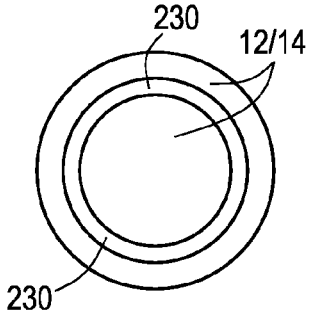
Figure 5C:
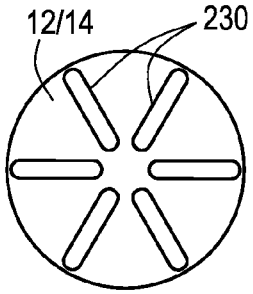

12. The flying disc 100 of embodiment 11, wherein said one or more light-emitting devices 23*a* form a light display comprising at least two light portions 230 spaced from one another along said disc body 10. As shown in FIGS. 5A-5C, a given light display may comprise any number of light portions 230 spaced from one another along said disc body 10, and forming a display of light portions 230 along (i) upper surface 12, (ii) a lower surface 14 of disc body 10, (iii) within disc body 10 (i.e., embedded therein, either within central body portion 11, a rim 15, or both central body portion 11 and rim 15), or (iv) any combination of (i) to (iii).

13. The flying disc 100 of embodiment 11 or 12, wherein said one or more light-emitting devices 23*a* emit light that is viewable from below said disc body 10 (i.e., as viewed along a direction $D_B$ as shown in FIG. 2).

14. The flying disc 100 of any one of embodiments 11 to 13, wherein said one or more light-emitting devices 23*a* are embedded within said disc body 10 (i.e., embedded therein, either within central body portion 11, a rim 15, or both central body portion 11 and rim 15).

15. The flying disc 100 of any one of embodiments 11 to 14, wherein said one or more light-emitting devices 23*a* are positioned along a lower surface 14 of said disc body 10.

16. The flying disc 100 of any one of embodiments 11 to 15, wherein each of said one or more light-emitting devices 23*a* comprises a multi-color light-emitting device 23*a*. For example, commercially available Triple Output LED RGB—SMD #COM-07844 from Sparkfun may be used.

17. The flying disc 100 of any one of embodiments 7 to 16, wherein said signaling device 20 comprises one or more sound-emitting devices 23 (not shown).

18. The flying disc 100 of any one of embodiments 7 to 17, wherein said circuitry 24 comprises a "latch" circuitry 241/242 that, when activated by rotation of said flying disc 100, turns the signaling device 23 "ON" and causes the signaling device 23 to remain "ON" until rotation of said flying disc 100 stops.

19. The flying disc 100 of any one of embodiments 7 to 18, wherein said circuitry 24, and/or said signaling device 23 enable a user to independently select specific first and second signals from a number of choices of said first and second signals. For example, a user may be able to select two specific colors, one specific color to display when body portion 11 of said disc body 10 rotates in the first direction $D_f$, and another specific color to display when body portion 11 of said disc body 10 rotates in the second direction $D_s$.

20. The flying disc 100 of any one of embodiments 1 to 19, further comprising at least one battery 32 capable of providing power to said signal-generator 20.

21. The flying disc 100 of any one of embodiments 7 to 20, further comprising at least one rechargeable battery 32 capable of providing power to said signal-generator 20.

22. The flying disc 100 of any one of embodiments 7 to 21, wherein said signal-generator 20 further comprises a housing 25 that at least partially encloses said first component 21, said microprocessor 22, and said circuitry 24.

23. The flying disc 100 of embodiment 22, wherein said housing 25 is sized to at least partially enclose said at least one battery 32.

24. The flying disc 100 of embodiment 22 or 23, wherein said housing 25 is attachable to said disc body 10.

25. The flying disc 100 of embodiment 22 or 23, wherein said housing 25 is integrally formed within said disc body 10.

26. The flying disc 100 of any one of embodiments 22 to 25, wherein said housing 25 further comprises a housing battery-charging port 36 (see, port 36 in FIG.) that enables a user to charge one or more batteries 32 positioned within said housing 25 via an electrical cord (not shown), such as a USB cable or a standard electrical cord, that plugs into a computer port, a wall socket, a car power outlet, or any other power source (not shown).

27. The flying disc 100 of any one of embodiments 1 to 26, further comprising an on-off switch (not shown) that enables a user to turn "ON" or "OFF" said signal-generator 20 regardless of whether flying disc 100 is rotating or not. When this on/off switch is present, this on/off switch overrides the above-described "latch circuit" 241/242 when present.

28. The flying disc 100 of any one of embodiments 1 to 27, wherein at least a portion of said signal-generator 20 extends along said upper surface 12 of said disc body 10, and another portion of said signal-generator 20 extends along a lower surface 14 of said central body portion 11, said lower surface 14 being opposite said upper surface 12.

29. The flying disc 100 of any one of embodiments 1 to 28, wherein said signal-generator 20 extends through said central body portion 11 from said upper surface 12 of said disc body 10 to a lower surface 14 of said central body portion 11, said lower surface 14 being opposite said upper surface 12.

30. The flying disc 100 of any one of embodiments 1 to 27, wherein said signal-generator 20 extends along a lower surface 14 of said central body portion 11, said lower surface 14 being opposite said upper surface 12.

31. The flying disc 100 of any one of embodiments 1 to 30, further comprising a disc rim 15 extending downward from said outer periphery 13 of said central body portion 11, said disc rim 15 forming a lowermost surface 16 of said disc body 10.

32. The flying disc 100 of any one of embodiments 1 to 31, wherein said disc body 10 does not comprise any openings therethrough (i.e., "openings" being defined as an unfilled aperture, not a filled aperture in the case where the signal generator 20 extends through an aperture within the disc body 10, but the aperture is filled with signal generator component(s) (e.g., part of housing 25).

33. The flying disc 100 of any one of embodiments 1 to 32, wherein said disc body 10 comprises a single part formed from one or more part materials selected from polymers, metals, fibers, fillers, or any combination thereof.

34. The flying disc 100 of any one of embodiments 1 to 33, wherein said disc body 10 comprises a single part formed from one or more polymers.

35. The flying disc 100 of any one of embodiments 1 to 34, wherein said flying disc 100 has an overall diameter, d (as shown in FIG. 2), of from about 6.0 inches (in) to about 18.0 in (or any diameter value between 6.0 in and 18.0 in, in increments of 0.1 in, for example, about 10.5 in, or any range of diameter values between 6.0 in and 18.0 in, in increments of 0.1 in, for example, from about 9.5 in to about 11.0 in).

36. The flying disc 100 of any one of embodiments 1 to 35, wherein said flying disc 100 has an overall diameter, d, of from about 9.5 in to about 11.0 in.

37. The flying disc 100 of any one of embodiments 1 to 36, wherein said flying disc 100 has an overall diameter, d, of from about 10.5 in.

38. The flying disc 100 of any one of embodiments 1 to 37, wherein said flying disc 100 has an overall weight of from about 50.0 grams (g) to about 250.0 g (or any weight value between 50.0 g and 250.0 g, in increments of 0.1 g, for example, about 175.0 g, or any range of weight values between 50.0 g and 250.0 g, in increments of 0.1 g, for example, from about 175.0 g to about 179.3 g).

39. The flying disc 100 of any one of embodiments 1 to 38, wherein said flying disc 100 has an overall weight of from about 100.0 g to about 210.0 g.

40. The flying disc 100 of any one of embodiments 1 to 39, wherein said flying disc 100 has an overall weight of from about 175.0 g to about 179.5 g.

Methods of Making Flying Discs

41. A method of making the flying disc 100 of any one of embodiments 1 to 40, said method comprising: attaching the signal-generator 20 to the disc body 10.

42. The method of embodiment 41, said method further comprising: thermoforming the disc body 10.

43. The method of embodiment 41 or 42, said method further comprising: providing components for forming the signal-generator 20, the components comprising (i) a first component 21 that detects rotation (i.e., either in direction $D_f$ or $D_s$) of the disc body 10, (ii) a second component 22 that detects rotational direction (i.e., either direction $D_f$ or $D_s$), (iii) the signaling device 23, and (iv) circuitry 24 that connects the first component 21, the second component 22, and the signaling device 23 to one another.

44. The method of any one of embodiments 41 to 43, said method further comprising: assembling components to form the signal-generator 20, the components comprising (i) a first component 21 that detects rotational (i.e., either in direction $D_f$ or $D_s$) of the disc body 10, (ii) a second component 22 that detects rotational direction (i.e., either direction $D_f$ or $D_s$), (iii) the signaling device 23, and (iv) circuitry 24 that connects the first component 21, the second component 22, and the signaling device 23 to one another.

45. The method of embodiment 43 or 44, wherein the first component 21 comprises at least two or more rolling ball tilt switches 31 that detect spin of flying disc 100. See, for example, rolling ball tilt switches SW1 and SW2 shown in FIGS. 6-7A.

46. The method of any one of embodiments 43 to 45, wherein the first component 21 comprises at least one rolling ball tilt switch 34 that detects direction of spin of flying disc 100. See, for example, four directional tilt sensor JP1 (i.e., an exemplary rolling ball tilt switch 34) shown in FIGS. 6-8.

47. The method of any one of embodiments 43 to 46, wherein each signaling device 23 comprises a multi-color light-emitting device 23*a*. For example, commercially available Triple Output LED RGB—SMD #COM-07844 from Sparkfun may be used.

48. The method of any one of embodiments 43 to 47, wherein the circuitry 24 comprises a "latch" circuitry 241/242 (described above) that, when activated by rotation of the flying disc 100, turns the signaling device 23 "ON" and causes the signaling device 23 to remain "ON" until rotation of the flying disc 100 stops.

49. The method of any one of embodiments 43 to 48, wherein the circuitry 24 and/or the signaling device 23 enable a user to independently select specific first and second signals from a number of choices of the first and second signals.

50. The method of any one of embodiments 43 to 49, further comprising positioning at least one battery 32 so as to provide power to the signal-generator 20.

51. The method of any one of embodiments 43 to 50, further comprising positioning at least one rechargeable battery 32 so as to provide rechargeable power to the signal-generator 20.

52. The method of any one of embodiments 41 to 51, said method further comprising: thermoforming a housing 25 sized to at least partially enclose components for forming the signal-generator 20, the components comprising (i) a first component 21 that detects rotation of the disc body 10 (i.e., either in direction $D_f$ or $D_s$), (ii) a second component 22 that detects rotational direction of the disc body 10 (i.e., either direction $D_f$ or $D_s$), (iii) the signaling device 23, and (iv) circuitry 24 that connects the first component 21, the second component 22, and the signaling device 23 to one another.

53. The method of embodiment 52, wherein the housing 25 fully encloses components for forming the signal-generator 20.

54. The method of embodiment 52 or 53, said method further comprising: attaching the housing 25 to the disc body 10.

55. The method of any one of embodiments 52 to 54, wherein said thermoforming a housing 25 step comprises forming a housing battery-charging port 36 within housing 25 that enables a user to charge one or more batteries 32 positioned within the housing 25 via an electrical cord (not shown), such as a USB cable or a standard electrical cord, that plugs into a computer port, a wall socket, a car power outlet, or any other power source (not shown).

Methods of Using Flying Discs

56. A method of using the flying disc 100 of any one of embodiments 1 to 40, said method comprising: throwing the flying disc 100 to cause the flying disc 100 to spin in either the first direction $D_f$ or the second direction $D_s$.

57. A method of repairing the flying disc 100 of any one of embodiments 1 to 40, said method comprising: replacing the signal-generator 20 or a component thereof (e.g., any one of or any combination of: first component 21, the second component 22, signaling device 23, circuitry 24 and housing 25).

58. The method of embodiment 56 or 57, further comprising independently selecting specific first and second signals (e.g., first and second colors) from a number of choices of said first and second signals (e.g., a choice of up to 20 different colors).

59. The method of any one of embodiments 56 to 58, further comprising charging one or more batteries 32 positioned within the housing 25 via an electrical cord (not shown), such as a USB cable or a standard electrical cord, that plugs into a computer port, a wall socket, a car power outlet, or any other power source (not shown).

60. The method of any one of embodiments 56 to 59, further comprising turning "on" or "off" an on-off switch (not shown) that turns "ON" or "OFF" the signal-generator 20 regardless of whether flying disc 100 is rotating or not. When this on/off switch is present, this on/off switch overrides the above-described "latch circuit" 241/242 when present.

In addition, it should be understood that although the above-described flying discs and methods are described as "comprising" one or more components or steps, the above-described flying discs and methods may "comprise," "consists of," or "consist essentially of" the above-described components or steps of the flying discs and methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a flying disc and/or method that "comprises" a list of elements (e.g., components or steps) is not necessarily limited to only those elements (or components or steps), but may include other elements (or components or steps) not expressly listed or inherent to the flying disc and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a flying disc and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described flying discs and/or methods may comprise, consist essentially of, or consist of any of the herein-described components and features, as shown in the figures with or without any feature(s) not shown in the figures. In other words, in some embodiments, the flying disc and/or method of the present invention does not have any additional features/steps other than those shown in the figures, and such additional features, not shown in the figures, are specifically excluded from the flying disc and/or method. In other embodiments, the flying disc and/or method of the present invention does have one or more additional features that are not shown in the figures.

The present invention is described above and further illustrated below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Method of Making Flying Discs

Flying discs similar to exemplary flying disc 100 shown in FIGS. 1-7C were formed. To form the exemplary printed circuit board 40 shown in FIGS. 7A-7C, the following parts were utilized as described in Table 1 below.

TABLE 1

Parts List For Forming An Exemplary Printed Circuit Board

| Value | Quantity | Part No. | Component | Description |
|---|---|---|---|---|
| BC847BVN-7 | 2 | SOT563 | U1, U2 | transistor pair |
| 1N4148 | 2 | SOD123 | D1, D2 | diode |
| SPST_ON | 2 | SW520D | SW1, SW2 | Lacoste Ball 15 degree Tilt Switch |
| WS2812B | 1 | WS2812B | D3 | RGB LED - SMD common anode |
| RPI-1031 | 1 | SOP-6, 6SMD | JP1 | 4-directional tilt sensor |
| CR2032 | 1 | CR2032-SMD | U3 | surface mount battery holder |
| 22k Ω | 2 | R0603 | R1, R2 | resistor |
| 270 Ω | 2 | R0603 | R3, R4 | resistor |
| 10k Ω | 2 | R0603 | R5, R6 | resistor |
| 240 Ω | 1 | R0603 | R7 | resistor |
| 0 Ω | 4 | R0603 | R8 (Blue1), R9 (Red2), R10 (Grn1), R11 (Grn2) | resistor ("jumper") |

Figure 7A:
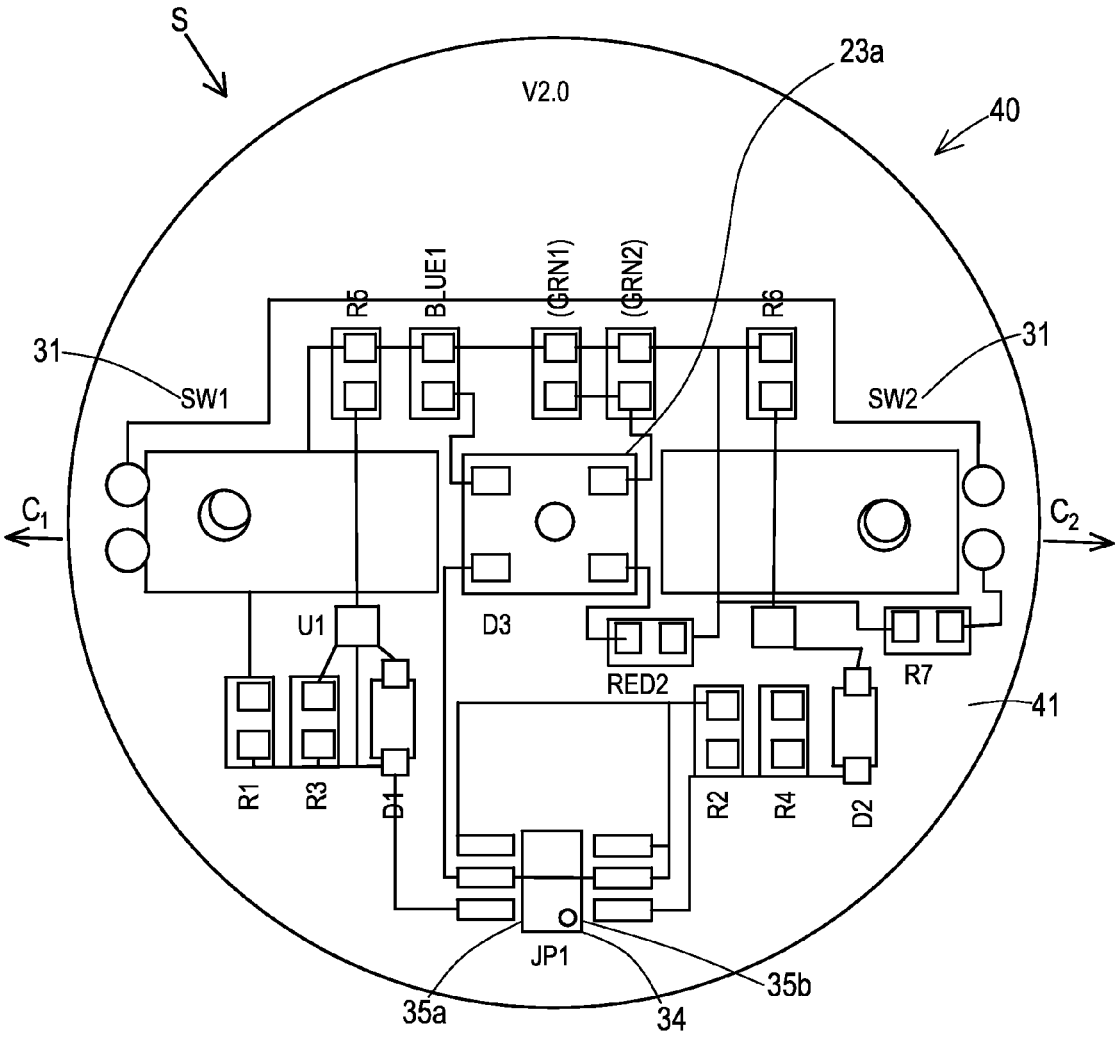
FIG. 7A depicts a front view of an exemplary printed circuit board that may be used in the exemplary signal-generator shown in FIGS. 1-2.
Figure 7B:
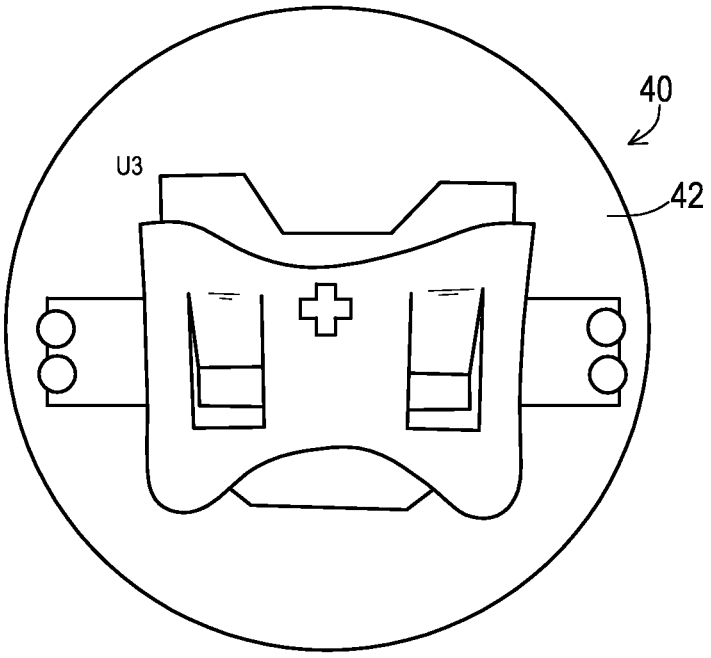
FIG. 7B depicts a rear view of the exemplary printed circuit board shown in FIG. 7A.
Figure 7C:
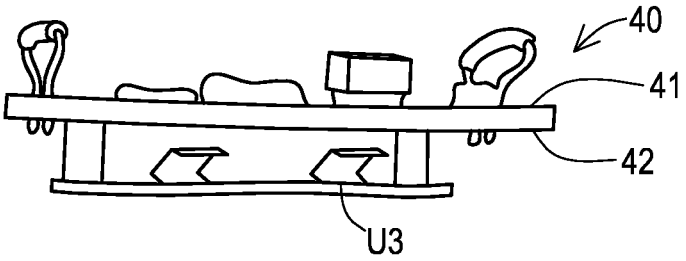
FIG. 7C depicts a side view of the exemplary printed circuit board shown in FIG. 7A as viewed along arrow S shown in FIG. 7A.

As shown in FIG. 7A, exemplary printed circuit board 40 comprises upper surface 41 with all of the various components shown in Table 1, except surface mount battery holder U3, positioned thereon. As shown in FIG. 7B, exemplary printed circuit board 40 comprises lower surface 42 with surface mount battery holder U3, positioned thereon.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A flying disc comprising:

a disc body comprising (i) a central body portion forming an upper surface of said disc body, and (ii) an outer periphery surrounding said central body portion; and a signal-generator positioned along said disc body, said signal-generator being capable of (1) generating a first signal in response to said disc body rotating in a first direction, said first direction being substantially perpendicular to a dissecting axis extending through said central body portion of said disc body, said first signal being a first color, and (2) generating a second signal in response to said disc body rotating in a second direction opposite said first direction, said second signal being a second color that is different from said first color, said signal-generator comprising:

(i) a first component that detects rotation of said disc body in said first direction or said second direction, (ii) a second component that detects direction of rotation of said disc body in either said first direction or said second direction, (iii) a signaling device providing said first and second signals, and (iv) circuitry that connects said first component, said second component, and said signaling device to one another.

2. The flying disc of claim 1, wherein said first component comprises at a centrifugal circuit comprising two or more rolling ball tilt switches that detect spin of said flying disc.

3. The flying disc of claim 2, wherein said second component comprises at least one rolling ball directional tilt switch that detects direction of spin of said flying disc, said at least one rolling ball directional tilt switch being activatable to generate (i) said first signal when said disc body rotates in said first direction, and (ii) said second signal when said disc body rotates in said second direction.

4. The flying disc of claim 3, wherein said circuitry comprises a "latch" circuitry that, when activated by rotation of said flying disc, turns the signaling device "ON" and causes the signaling device to remain "ON" until rotation of said flying disc stops.

5. The flying disc of claim 4, further comprising at least one battery capable of providing power to said signal-generator.

6. The flying disc of claim 5, wherein said at least one battery comprises a rechargeable battery.

7. The flying disc of claim 1, wherein at least one of (i) said circuitry, and (ii) said signaling device enables a user to independently select specific first and second colors from a number of choices of said first and second colors, each of said first and second colors being independently selected from red, yellow, blue, green, purple, orange, or any other color formed from any combination of two or more of red, yellow, blue, green.

8. The flying disc of claim 1, wherein said signaling device comprises one or more light-emitting devices, each of said one or more light-emitting devices comprising a multi-color light-emitting device.

9. The flying disc of claim 1, wherein said signal-generator further comprises a housing that at least partially encloses said first component, said second component, and said circuitry.

10. The flying disc of claim 9, wherein said housing is attachable to said disc body.

11. The flying disc of claim 9, wherein said housing is integrally formed within said disc body.

12. The flying disc of claim 9, wherein said housing further comprises a housing battery-charging port that enables a user to charge one or more batteries positioned within said housing via a USB cable or a standard electrical cord that plugs into a computer port, a wall socket, a car power outlet, or any other power source.

13. The flying disc of claim 1, further comprising an on-off switch that enables a user to turn "ON" or "OFF" said signal-generator regardless of whether flying disc is rotating or not.

14. The flying disc of claim 1, further comprising a disc rim extending downward from said outer periphery of said central body portion, said disc rim forming a lowermost surface of said disc body.

15. The flying disc of claim 14, wherein said disc body does not comprise any openings therethrough.

16. The flying disc of claim 14, wherein said disc body comprises a single part formed from one or more part materials selected from polymers, metals, fibers, fillers, or any combination thereof.

17. The flying disc of claim 14, wherein said flying disc has an overall diameter, d, of from about 6.0 inches (in) to about 18.0 in; and an overall weight of from about 50.0 grams (g) to about 250.0 g.

18. A flying disc comprising:

a disc body comprising (i) a central body portion forming an upper surface of said disc body, (ii) an outer periphery surrounding said central body portion, and (iii) a disc rim extending downward from said outer periphery of said central body portion, said disc rim forming a lowermost surface of said disc body;

a signal-generator positioned along said disc body, said signal-generator being capable of (1) generating a first signal in response to said disc body rotating in a first direction, said first direction being substantially perpendicular to a dissecting axis extending through said central body portion of said disc body, said first signal being a first color, and (2) generating a second signal in response to said disc body rotating in a second direction opposite said first direction, said second signal being a second color that is different from said first color, said signal-generator comprising:

(i)a first component that detects rotation of said disc body in said first direction or said second direction, said first component comprising a centrifugal circuit comprising two or more rolling ball tilt switches that detect spin of said flying disc;

(ii) a second component that detects direction of rotation of said disc body in either said first direction or said second direction, said second component comprising at least one rolling ball directional tilt switch that detects direction of spin of said flying disc, said at least one rolling ball directional tilt switch comprising a rolling ball, a first wall and a second wall, a first circuit that is activated to generate said first signal when said rolling ball comes into contact with said first wall, and a second circuit that is activated to generate said second signal when said rolling ball comes into contact with said second wall;

(iii) a signaling device providing said first and second signals, said signaling device comprising one or more light-emitting devices; and (iv) circuitry that connects said first component, said second component, and said signaling device to one another;

at least one battery capable of providing power to said signal-generator; and a housing that at least partially encloses said signal-generator and said at least one battery.

19. A flying disc comprising:

a disc body comprising (i) a central body portion forming an upper surface of said disc body, (ii) an outer periphery surrounding said central body portion, and (iii) a disc rim extending downward from said outer periphery of said central body portion, said disc rim forming a lowermost surface of said disc body; and a signal-generator positioned along said disc body, said signal-generator being capable of (1) generating a first signal in response to said disc body rotating in a first direction, said first direction being substantially perpendicular to a dissecting axis extending through said central body portion of said disc body, said first signal being a first color, and (2) generating a second signal in response to said disc body rotating in a second direction opposite said first direction, said second signal being a second color that is different from said first color wherein said signal-generator comprises:

a signaling device providing said first and second signals, said signaling device comprising one or more light-emitting devices;

at least one rolling-ball directional tilt switch that detects direction of spin of said flying disc, said at least one rolling ball directional tilt switch comprising a rolling ball, a first wall and a second wall, a first circuit that is activated to generate said first signal when said rolling ball comes into contact with said first wall, and a second circuit that is activated to generate said second signal when said rolling ball comes into contact with said second wall; and a "latch" circuitry that, when activated by rotation of said flying disc, turns the signaling device "ON" and causes the signaling device to remain "ON" until rotation of said flying disc stops; and wherein each of said first and second colors is independently selected from red, yellow, blue, green, purple, orange, or any other color formed from any combination of two or more of red, yellow, blue, green.

* * * * *